US006497089B2

(12) United States Patent
Lovas et al.

(10) Patent No.: US 6,497,089 B2
(45) Date of Patent: Dec. 24, 2002

(54) OPEN-END SPINNING APPARATUS AND A ROTOR COVER

(75) Inventors: Kurt Lovas, Böhmfeld (DE); Josef Schermer, Bergheim-Unterstall (DE); Frank Baier, Geisenfeld (DE)

(73) Assignee: Rieter Ingolstadt Spinnereimaschinenbauag, Ingolstadt (DE)

( * ) Notice: Subject to any disclaimer, the term of this patent is extended or adjusted under 35 U.S.C. 154(b) by 0 days.

(21) Appl. No.: 09/920,348

(22) Filed: Aug. 1, 2001

(65) Prior Publication Data

US 2002/0046558 A1 Apr. 25, 2002

(51) Int. Cl.[7] ..... D01H 4/08
(52) U.S. Cl. ..... 57/406; 57/404
(58) Field of Search ..... 57/406, 408, 411, 57/413, 414, 415, 417, 404, 400

(56) References Cited

U.S. PATENT DOCUMENTS 3,798,887 A 3/1974 Le Chatelier
4,339,910 A 7/1982 Ali et al.
5,638,671 A * 6/1997 Stahlecker et al. ..... 57/352
5,953,896 A * 9/1999 Stahlecker ..... 57/362
6,289,663 B1 * 9/2001 Schroder ..... 57/406
6,295,800 B1 * 10/2001 Stahlecker ..... 57/406

FOREIGN PATENT DOCUMENTS

DE 2419670 A1 11/1975
DE 2947480 A1 6/1981

OTHER PUBLICATIONS

German Search Report, Dec. 27, 2000.

* cited by examiner

*Primary Examiner*—Danny Worrell
(74) *Attorney, Agent, or Firm*—Dority & Manning

(57) ABSTRACT

The rotor cover (2) of an open-end spinning machine possesses a projecting cover cap (3) with a side recess (4), which, on its end remote from the rotor cover is bordered by a collar (40). This possesses both in the partial zone of its circumferential area containing the collar (40), and in the remaining circumferential zone, essentially the same outer contour. The recess (4) begins, relative to the direction of rotation (f) of the spin rotor 1, between 30° and 130° after the discharge opening (50) of the fiber feed conduit (5) and ends at a section of the of the wall (51) protruding from the radial surface (20) of the rotor cover (2). The recess (4) extends to a radial surface (20) of the rotor cover (2) which radial surface (20) covers the open side of the spin rotor.

16 Claims, 2 Drawing Sheets

OPEN-END SPINNING APPARATUS AND A ROTOR COVER

DESCRIPTION

The present invention concerns an open-end spinning apparatus in accord with the generic concept of claim 1 as well as a rotor cover in accord with the generic concept of claim 2.

DE 24 19 670 A1 has disclosed, that a thin space for a sealing element can be provided between the spin rotor and the rotor cover, in that area in which the fiber feed conduit discharges, while in the remaining area, a relatively greater separating distance remains untouched. However, experience has shown, that such utilization of space for sealing leads to disadvantageous results in consideration of the quality of the produced thread.

Accordingly, the purpose of the present invention is to create an open-end spinning apparatus, which avoids these disadvantages and with the aid of the invented open-end spinning apparatus, a positive effect is achieved regarding the thread quality, in particular where the tensile strength of said thread is concerned.

This purpose is achieved in accord with the invention by means of the features of the claim 1 or 2. Experience has surprisingly demonstrated, that by means of a recess in the cover cap of the rotor cover, located at that side thereof proximal to the free end of the said cover cap, the thread quality can be improved, especially in regard to the tensile strength and the uniformity of the thread.

Advantageously, the circumferential area of the cover cap which carries a collar, is designed in accord with claim 3 throughout its entire circumference. This is of advantage, both in regard to manufacture and in regard to the thread yield.

Advantageously, the invented recess is developed in accord with one or more of the claims 4 to 9, because such a design of the object of the invention, surprisingly, leads to especially fortunate thread results.

The object of the invention leads to better thread results, especially where the tensile strength of the thread is concerned, as well in regard to the uniformity of the thread. Moreover, the invented apparatus is simple to produce and can, upon need, even be made suitable for retrofit by an exchange of the rotor cover in an open-end spinning machine.

Figure 1:
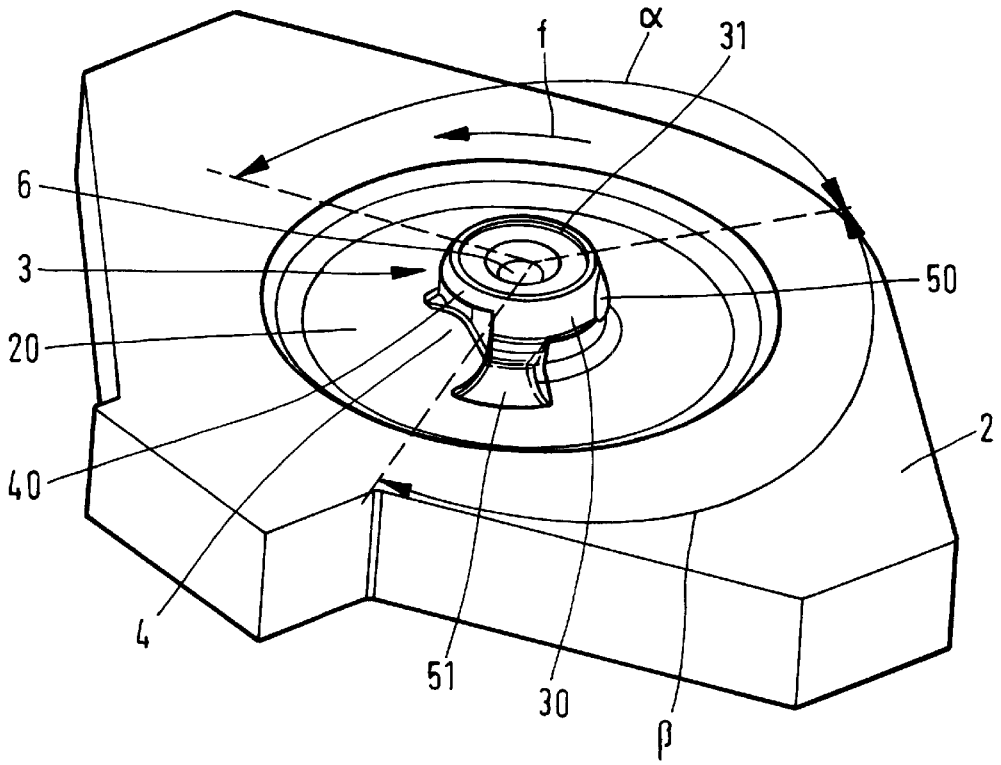
Figure 2:
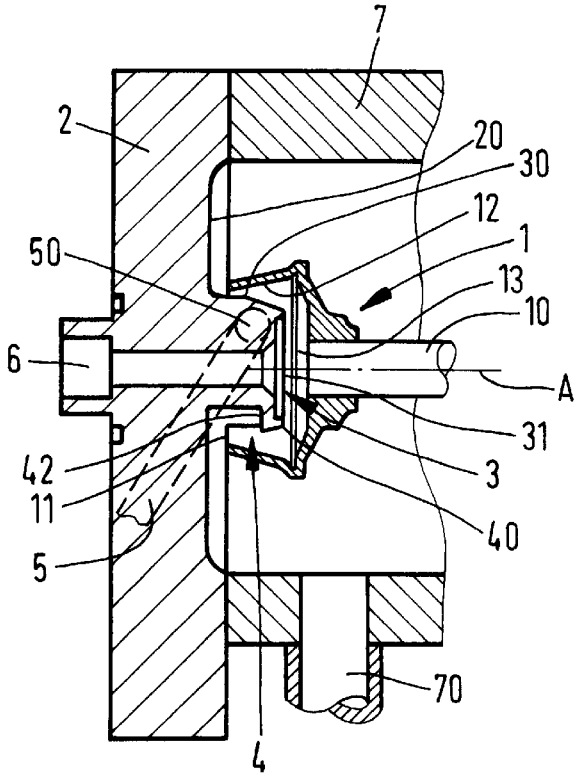
Figure 3:
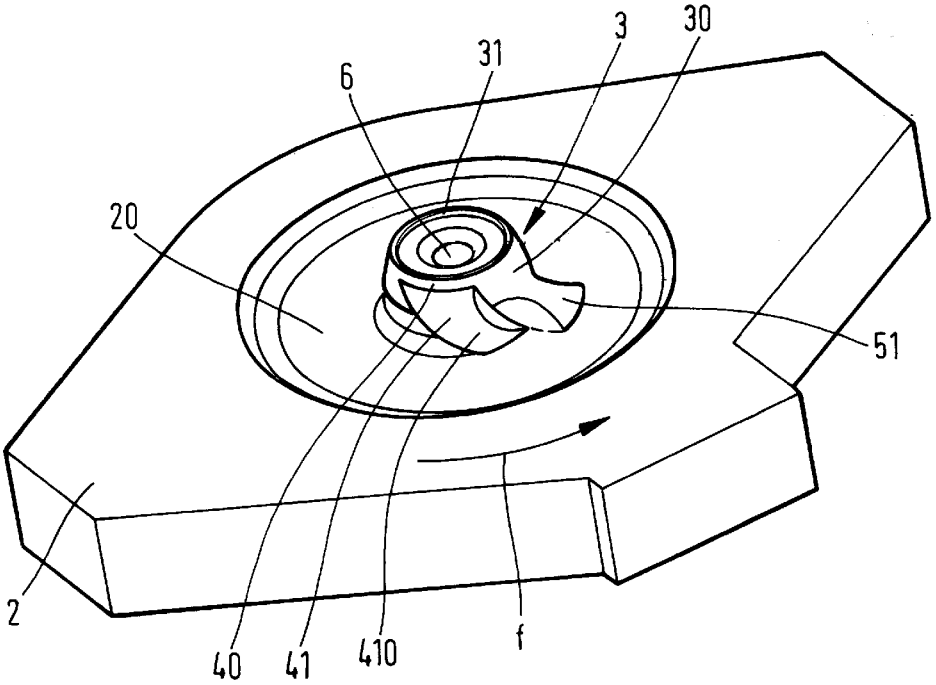
Figure 4:
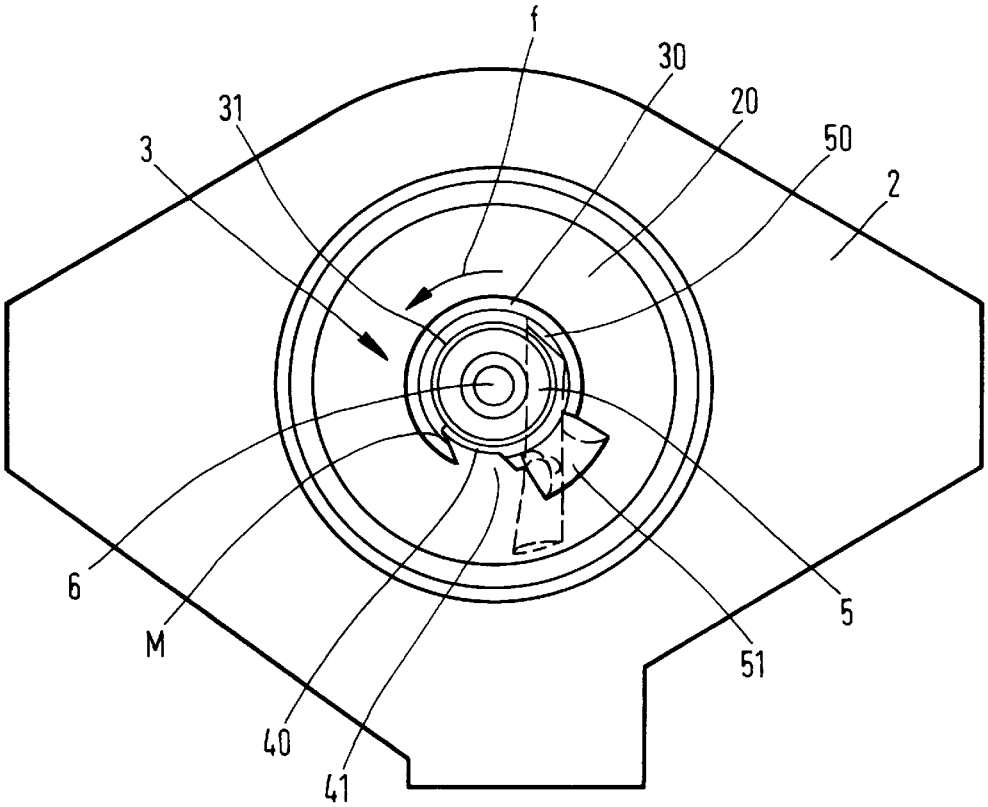

Embodiments of the invention are, in the following, explained with the aid of drawings There is shown in:

FIG. 1 a rotor cover of invented design in a perspective view,

FIG. 2 the rotor cover shown in FIG. 1 in section, together with the spin rotor and a portion of its housing, FIG. 3 an altered version of the rotor cover depicted in FIGS. 1, 2 in a perspective view; and FIG. 4 in a changed perspective, the rotor cover shown in FIG. 3 in a front view.

FIG. 2, depicts a spin rotor 1, which, in a known manner, and thus need not be shown, is supported in bearings by means of its driving shaft 10. The spin rotor 1 itself is enclosed in a housing 7, which is connected to a suction line 70.

On its side distal from the shaft 10, the spin rotor 1 possesses an open side 11, which, during the spinning process, is covered by a rotor cover 2. This rotor cover 2 exhibits on its side proximal to the spin rotor 1, a cover cap 3 which projects itself into the said open side 11 of the spin rotor 1 and accommodates a fiber feed conduit 5, which in turn possesses a discharge opening 50 directed against the inner, circumferential wall 12 of the spin rotor 1. This fiber feed conduit 5 has the purpose of delivering to the spin rotor 1, individualized fibers (not shown) which are captured in the fiber capture groove 13 of the spin rotor 1 and are bound into the end of a thread (likewise not shown) which thread is continually led out of the spin rotor 1 through a thread removal conduit 6 concentric with the cover cap 3 in the rotor cover 2. The thread is then, in a procedure not shown, wound on a (not shown) spool.

As the FIGS. 1 and 2 demonstrate, the cover cap 3 exhibits a conical circumferential surface 30, which, in a partial zone, is interrupted by a recess 4. This recess 4 does not extend up to the terminal face 31 of the cover cap 3 which is distal from the rotor cover 2, but is kept separate from this by a collar 40.

The transport of the fibers into the spin rotor is carried out with the aid of an air flow, which is generated by suction in the spin rotor 1 which is applied thereto by the suction line 70. In the spin rotor 1, the fibers must be separated from that same air flow, with the help of which they were thereto transported, and subsequently deposited on inner circumferential wall 12 of the spin rotor 1. It is along this wall 12 that the fibers slide because of the conicity of this inner, circumferential wall 12 and because of the high rotational speed of the spin rotor 1 during the spin process. The fibers slide into the fiber capture groove 13, in order to be bound into the continuously removed thread, running from the said spin rotor 1.

This separation of the fibers from the transport air stream, is done by a change-of-direction of this transport flow, wherein, the fibers, because of their mass, and the thereby generated momentum carry on their flight in the prior transport direction until reaching the inner circumferential wall 12 of the spin rotor 1. So that the fibers reach this inner circumferential wall 12 in a stretched condition, the transport air stream in the fiber feed conduit 5 acts upon the fibers with a high intensity. This air flow should, in the spin rotor 1 lose its intensity to such a degree, that its influence on the fibers brought to the spin rotor 1 quickly ebbs and favors the ejection of the fibers from the air stream. This separation is accomplished with the aid of the said recess 4. This recess 4 offers, in a radial direction, a greater distance to the spin rotor 1 which surrounds the cover cap 3, or otherwise expressed, a lesser radial distance from the thread removal conduit 6 which extends itself into the cover cap 3 than the remaining zone of the circumferential surface 30 of the cover cap 3. The air has more space available here and can on this account expand. As it expands, this action brings about a reduction in the velocity of the air flow, which in turn favors the ejection of the fibers out of the transport air.

Referring to the direction of rotation—depicted by the arrow f—of the spin rotor 1 during the spinning process, the recess 4, which brings about the said air expansion, begins in the illustrated embodiment between 30° and 130° after the discharge opening 50 of the fiber feed conduit 5. The start of the recess 4 depends, in the individual case, on various factors, such as the transport velocity of the transport air flow, the diameter and the rotational speed of the spin rotor 1 and the like. The recess 4 extends itself over a greater part of the circumferential range of the cover cap 3. This circumferential range itself, as a rule, is greater than the separative distance of the beginning of the recess 4 after the entrance of the fiber feed conduit 5 which is shown as angle α. This can extend over more than three quarters of the circumference of the cover cap 3, so that, in case of just such a design, the recess 4 terminates at an acute angle β, before the discharge opening 50 of the fiber feed conduit 50.

In the case of the embodiment in accord with the FIGS. 1, 3 and 4, provision has been made, that a portion of the wall 51 of the fiber feed conduit 5, is to rise beyond the radial surface 20 of the rotor cover 2 which is opposite to the open side 11 of the spin rotor 1, so that the fiber feed conduit can open very flatly into the spin rotor 1. In such a case, provision can be made, that the recess 4 end directly at the beginning of this wall 51 of the fiber feed conduit which is forming a rise in the contour of surface 20.

After the separation of the fibers from the flow of air, the air is led to the open side 11 of the spin rotor 1 by means of the action of the suction. This suction is generated with the aid of the suction piping 70 which is continually under suction and is connected in the housing 7 enclosing the spin rotor 1. The so produced suction in the housing 7 has the effect, that the air found in the spin rotor 1 is transported to the open side 11 of the spin rotor 1 and leaves said rotor in the direction of the housing 7.

Surprisingly, it has become known that placing a limitation on the recess 4 on its end which is proximal to the end face 31 of the cover cap 3 with the aid of a collar 40 leads to an improvement of the thread quality, in particular in consideration of the tensile strength and the uniformity of the produced thread.

The previously described apparatus is not limited to the described and illustrated design, but, while remaining within the framework of the invention, the apparatus can be altered in a multitude of ways. For instance, through the exchange of features by equivalents or again, by other combinations of the given features, or yet equivalents of these latter combinations. Thus, it is not necessary, that the recess 4 extend itself along a generatrix M of the outside surface of the cover cap 3. In accord with the embodiment shown in FIGS. 3 and 4, a recess is depicted, which shows the inclination, that the recess—relative to the direction of rotation of the spin rotor 1, as marked by the arrow f—begins at the collar 40 and with increasing distance from the discharge opening 50 of the fiber feed conduit 5, finds itself at an ever increasing distance from said collar 40 as it approaches the rotor cover 2. In this way, consideration is given to the fact, that the air in the spin rotor 1 will be picked up by the said rotor in its rotation and spirally led to the open side 11 of the rotor. The start of the recess 4 is found in this case at the location, at which the air expansion is desired in order that the velocity of the air is reduced in the interest of a more certain ejection of the fibers from the transport air flow. At the same time, the inclination of the recess 41 aids in the removal of the air from the interior of the spin rotor.

As a rule, there is sufficient space between the open side of the spin rotor 1, that is, the rotor rim, on the one hand and the radial surface 20 of the rotor cover 2 which lies opposite to this on the other hand, in order to exhaust the air in the necessary quantities from the interior of the spin rotor 1. The recess 4 extends itself on this account, in accord with the embodiment shown in FIGS. 1 and 2, from the collar 40 to the open side 11 of the opposite radial surface 20 of the rotor cover 2 of the spin rotor 1.

By the term"radial surface 20" is to be understood in connection with the present description, that surface of the rotor cover 2, which lies opposite to the open side 11 of the spin rotor, that is, the rim of the rotor is independent thereof, as to whether or not the rotor cover possesses other radial surfaces which may have other functions. One of the these functions might be the interposition of an appropriate sealing means—for application on the housing 7 which encompasses the spin rotor.

In accordance with the relationships in air condition in the spin rotor 1 and in the housing 7, which are subject to various states due to low pressure, rotor rotational speed, rotor diameter and the like, it can be sufficient, if the recess 4, 41 extends itself essentially over that longitudinal zone of the cover cap 3, at which the velocity reduction of the air is desired. In this way, under certain circumstances, it can be entirely sufficient if the recess 4, 41 terminates even within the spin rotor 1, that is even before the reaching of the open side 11 thereof. However, under other presuppositions, the recess 4, 41 can extend to the radial surface opposite to the open side 11 of the spin rotor as this has been described previously with the aid of FIGS. 1 and 2.

In individual cases, especially with spin rotors 1 with a small diameter, it can, however, be of value, if, as this is shown in the example of the recess 41 in FIG. 3, if the recess extends over the radial surface 20 of the rotor cover 2 until it penetrates into a cavity 410 which is provided there.

The recess 4, 41 can be made to be parallel on both its ends to the rotor axis A (see FIG. 1) likewise as on its sides in the circumferential direction of the cover cap 3, the recess can be shaped in various manners. Thus abrupt transitions are just as possible as gentle transitions. The choice, as to how these ends or sides of the recess 4, 41 are designed depends, first, on the possibilities of fabrication, however, second, it is necessary that the construction must be such as to avoid turbulence in the air flow, which can be counterproductive to the fiber separation and deposition. Experience has shown, that a radial border surface 42 (FIG. 2), especially on the end of the recess 4 proximal to the collar 40 acts particularly favorably on the quality of the thread.

The recess 4, 41, in the illustrated embodiments, is shaped during the manufacture of the rotor cover 2. This is accomplished, for example, during corresponding shaping by injection molding or by shaping by stamping. Also an essentially radial, bordering surface 42 can be molded during the manufacture of the rotor cover 2. It can also be advantageously provided, that the collar 40, be formed by means of a platelike collar of a conventional, exchangeable thread removal nozzle (not shown).

In this case, a collar 40 of this type, extends so far outward, that it borders the recess 4, 41 at its end remote from the rotor cover 2 in the described manner. Where small spin rotors are concerned, for instance with a diameter of the fiber capture ring of 26 mm and smaller, such a formulation of the cover cap 3 is particularly favorable. By means of that advantageous embodiment of the invention, the cover cap 3, when viewed in the axial direction, can be made somewhat shorter, without the danger that the collar 40 and its advantageous action must be dispensed with.

Where the collar 40 is located, the cover cap 3 possesses an outer contour, which remains unchanged over its entire circumferential area, as seen in the illustrated embodiments. This is seen as necessary from the basis of manufacture, but, as a rule, it is also of value for the conducting of air flow within the spin rotor 1. There can be no objection brought forth, if the circumferential zone of the cover cap 3 shows a differently designed configuration. For instance, provision can be made, that the cover cap 3, in that part between the fiber discharge opening 50 of the fiber conduit 5 and the beginning of the recess 4, 41, on the one hand, and the end face 31 of the of said cover cap 3 on the other hand, exhibits a fiber guide surface (not shown), which extends itself relatively farther in the direction of the inner circumferential wall 12 of the spin rotor 1. In this case there would exist a greater separation from the thread removal conduit 6 than from the remaining circumferential area of the cover cap 3. This would favor the orderly deposition of the fibers on the inner circumferential surface 12. In connection with a fiber handling surface of this kind, a reduction of the diameter of the cover cap 3, as compared to its normal outer diameter, could be brought about, wherein this diameter reduction can be partially carried on into the zone of the collar 40.

The circumferential surface 30 of the cover cap 3 is not limited to the conical shape shown in FIG. 1 to FIG. 4, but can optionally also exhibit a cylindrical shape, or be composed of an assembly of longitudinal sections of various forms, wherein the recess 4, 41, is placed in an appropriate manner in the created circumferential surface 30 and be independent of any special shape.

In similar manner, the end face 31 of the cover cap 3 plays no role in connection with the construction of the recess 4, 41 or with the collar 40 which borders said recess 4, 41.

Frequently, in previous statements, reference has been made in regard to a thread removal conduit 6, which is at least partially to be found in the cover cap 3. In this case, the term,"thread removal conduit 6" should be interpreted in such a manner, that it is either a conventional thread removal nozzle or else it encompasses an element of thread guidance in the cover cap 3, such as an axial boring, or an attachment.

What is claimed is:

1. An open-end spinning apparatus within a workstation of an open-end spinning machine containing a plurality of said workstations, said open-end spinning apparatus comprising:

a spin rotor having a conical wall defining an open-end of said spin rotor;

a rotor cover with a radial surface operably disposable to said conical wall of said spin rotor, said radial surface forming a partial side of a rotor housing in which said spin rotor operates;

a rotor cap projecting axially from said radial surface, said rotor cap extending into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface; and wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess.

2. An open-end spinning apparatus as in claim 1, wherein said rotor cap and said collar possess a uniformly shaped outside contour.

3. An open-end spinning apparatus as in claim 1, wherein said section of said rotor cap defining said recess forms an essentially radial bordering surface proximal to said collar.

4. An open-end spinning apparatus within a workstation of an open-end spinning machine containing a plurality of said workstations, said open-end spinning apparatus comprising:

a spin rotor having a conical wall defining an open-end of said spin rotor;

a rotor cover with a radial surface operably disposable to said conical wall of said spin rotor, said radial surface forming a partial side of a rotor housing in which said spin rotor operates;

a rotor cap projecting axially from said radial surface, said rotor cap extending into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface;

wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess; and wherein said section of said rotor cap begins to define said recess between 30° and 130° from said discharge opening formed by said rotor cap in the direction of rotation of said spin rotor.

5. An open-end spinning apparatus as in claim 4, wherein said section of said rotor cap ceases to define said recess in such a manner that an acute angle is formed in the direction of rotation of said spin rotor between the end of said section defining said recess and said discharge opening formed by said rotor cap.

6. An open-end spinning apparatus within a workstation of an open-end spinning machine containing a plurality of said workstations, said open-end spinning apparatus comprising:

a spin rotor having a conical wall defining an open-end of said spin rotor;

a rotor cover with a radial surface operably disposable to said conical wall of said spin rotor, said radial surface forming a partial side of a rotor housing in which said spin rotor operates;

a rotor cap projecting axially from said radial surface, said rotor cap extending into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface;

wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess; and wherein said section of said rotor cap defining said recess extends up to a portion of said rotor cap which forms said fiber feed conduit, said portion of said rotor cap at the end proximal to said radial surface radially projecting further out than other portions of said rotor cap.

7. An open-end spinning apparatus as in claim 1, wherein said section of said rotor cap defines said recess by forming an inclination starting from an end proximal to said collar and ending at an end proximal to said radial surface in the direction of rotation of said spin rotor.

8. An open-end spinning apparatus as in claim 1, wherein said recess does not reach said radial surface.

9. A rotor cover of an open-end spinning workstation which covers a spin rotor of said workstation, said rotor cover comprising:

a radial surface operably disposable to a conical wall of said spin rotor that forms an open-end of said spin rotor, said radial surface forming a partial side of a rotor housing in which said spin rotor operates;

a rotor cap projecting axially from said radial surface, said rotor cap positionable so as to extend into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface; and wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess.

10. A rotor cover as in claim 9, wherein said rotor cap and said collar possess a uniformly shaped outside contour.

11. A rotor cover as in claim 9, wherein said section of said rotor cap defining said recess forms an essentially radial bordering surface proximal to said collar.

12. A rotor cover of an open-end spinning workstation which covers a spin rotor of said workstation, said rotor cover comprising:

a radial surface operably disposable to a conical wall of said spin rotor that forms an open-end of said spin rotor, said radial surface forming a partial side of a rotor housing in which said spin rotor operates;

a rotor cap projecting axially from said radial surface, said rotor cap positionable so as to extend into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface;

wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess; and wherein said section of said rotor cap begins to define said recess between 30° and 130° from said discharge opening formed by said rotor cap in the direction of rotation of said spin rotor.

13. A rotor cover as in claim 12, wherein said section of said rotor cap ceases to define said recess in such a manner that an acute angle is formed in the direction of rotation of said spin rotor between the end of said section defining said recess and said discharge opening formed by said rotor cap.

14. A rotor cover of an open-end spinning workstation which covers a spin rotor of said workstation, said rotor cover comprising:

a radial surface operably disposable to a conical wall of said spin rotor that forms an open-end of said spin rotor, said radial surface forming a partial side of a rotor housing in which said spin rotor operates;

a rotor cap projecting axially from said radial surface, said rotor cap positionable so as to extend into said open-end of said spin rotor between an inner surface of said conical wall;

wherein said rotor cap forms a portion of a yarn removal conduit concentric around the axis of said rotor cap and said spin rotor through which a yarn spun in said spin rotor is removed from said workstation, and said rotor cap forms a fiber feed conduit and a discharge opening through which fibers travel until said fibers are discharged from said discharge opening against said inner surface of said conical wall of said spin rotor;

a collar operably disposed on an axial end of said rotor cap distal from said radial surface;

wherein a section of the circumference of said rotor cap defines a recess between said radial surface and said collar, said rotor cap being a greater distance from said inner surface of said conical wall of said spin rotor at said section than the rest of the circumference of said rotor cap due to said defined recess; and wherein said section of said rotor cap defining said recess extends up to a portion of said rotor cap which forms said fiber feed conduit, said portion of said rotor cap at the end proximal to said radial surface radially projecting further out than other portions of said rotor cap.

15. A rotor cover as in claim 9, wherein said section of said rotor cap defines said recess by forming an inclination starting from an end proximal to said collar and ending at an end proximal to said radial surface in the direction of rotation of said spin rotor.

16. A rotor cover as in claim 9, wherein said recess does not reach said radial surface.

* * * * *